US009182709B2

(12) United States Patent
Naitoh et al.

(10) Patent No.: US 9,182,709 B2
(45) Date of Patent: Nov. 10, 2015

(54) FIXING DEVICE, IMAGE FORMING APPARATUS WITH SAME, AND METHOD OF ASSEMBLING FIXING DEVICE

(71) Applicants: Yutaka Naitoh, Hyogo (JP); Shigeo Nanno, Kyoto (JP); Tomohiko Fujii, Hyogo (JP); Minoru Toyoda, Hyogo (JP); Hitoshi Fujiwara, Osaka (JP); Tomoya Adachi, Hyogo (JP); Yasuharu Kawarasaki, Osaka (JP); Tetsu Morino, Kanagawa (JP)

(72) Inventors: Yutaka Naitoh, Hyogo (JP); Shigeo Nanno, Kyoto (JP); Tomohiko Fujii, Hyogo (JP); Minoru Toyoda, Hyogo (JP); Hitoshi Fujiwara, Osaka (JP); Tomoya Adachi, Hyogo (JP); Yasuharu Kawarasaki, Osaka (JP); Tetsu Morino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 55 days.

(21) Appl. No.: 14/024,900

(22) Filed: Sep. 12, 2013

(65) Prior Publication Data

US 2014/0093288 A1 Apr. 3, 2014

(30) Foreign Application Priority Data

Oct. 2, 2012 (JP) ..... 2012-220522

(51) Int. Cl.
*G03G 15/20* (2006.01)

(52) U.S. Cl.
CPC ..... *G03G 15/2017* (2013.01); *G03G 15/2053* (2013.01); *G03G 15/2078* (2013.01); *G03G 2215/0132* (2013.01); *G03G 2215/2035* (2013.01)

(58) Field of Classification Search
CPC ..... G03G 15/2017; G03G 15/2039; G03G 15/2042; G03G 15/2053; G03G 15/2078; G03G 15/2082; G03G 2215/2003
See application file for complete search history.

(56) References Cited

U.S. PATENT DOCUMENTS

| | | | | |
|---|---|---|---|---|
| 7,635,199 | B2 * | 12/2009 | Guo et al. | 362/241 |
| 8,010,028 | B2 * | 8/2011 | Shinshi | 399/329 |
| 2011/0058864 | A1 | 3/2011 | Fujimoto et al. | |
| 2011/0170919 | A1 * | 7/2011 | Fujiwara et al. | 399/331 |
| 2012/0177422 | A1 | 7/2012 | Nanno et al. | |
| 2012/0275834 | A1 | 11/2012 | Naitoh et al. | |
| 2013/0064586 | A1 | 3/2013 | Adachi et al. | |
| 2013/0176722 | A1 * | 7/2013 | Lay et al. | 362/231 |
| 2013/0279955 | A1 * | 10/2013 | Maeda | 399/329 |

(Continued)

FOREIGN PATENT DOCUMENTS

| | | |
|---|---|---|
| JP | 2002-108119 | 4/2002 |
| JP | 2011-059365 | 3/2011 |

(Continued)

*Primary Examiner* — David Gray
*Assistant Examiner* — Carla Therrien
(74) *Attorney, Agent, or Firm* — Oblon, McClelland, Maier & Neustadt, L.L.P.

(57) ABSTRACT

A fixing device fixes a toner image on a recording medium transported to a fixing nip by applying pressure and heat to the recording medium. The fixing device includes an endless belt formed into a loop with both ends bonded together, the belt accommodating a heat source inside thereof, a pressing roller rotating in contact with the endless belt forming the fixing nip between the endless belt and the pressing roller, and a fixed member provided inside a loop of the endless belt to press the endless belt against a pressing roller. A reinforcing member is bonded to the fixed member inside the loop of the endless belt to reinforce the fixed member. A reflector is provided to reflect light emitted from the heat source toward the inner circumferential surface of the endless belt. The reflector is held on the reinforcing member by either plastically or elastically deforming by itself.

20 Claims, 6 Drawing Sheets

(56) References Cited

U.S. PATENT DOCUMENTS

| | | | | |
|---|---|---|---|---|
| 2014/0056625 | A1* | 2/2014 | Naitoh et al. | 399/329 |
| 2014/0112691 | A1* | 4/2014 | Nanno et al. | 399/329 |

FOREIGN PATENT DOCUMENTS

| | | |
|---|---|---|
| JP | 2011-095539 | 5/2011 |
| JP | 2011-137931 | 7/2011 |

* cited by examiner

FIXING DEVICE, IMAGE FORMING APPARATUS WITH SAME, AND METHOD OF ASSEMBLING FIXING DEVICE

CROSS-REFERENCE TO RELATED APPLICATION

This patent application is based on and claims priority pursuant to 35 U.S.C. §119 to Japanese Patent Application No. 2012-220522, filed on Oct. 2, 2012 in the Japan Patent Office, the entire disclosure of which is hereby incorporated by reference herein.

BACKGROUND

1. Technical Field

The present invention relates to a fixing device installed in an image forming apparatus, such as a printer, a copier, etc., and in particular to a fixing device capable of fixing a toner image onto a recording medium by applying heat and pressure thereto.

2. Related Art

Conventionally, as a toner image fixing device used in an image forming apparatus, such as a printer, a copier, etc., a heat roller-type fixing device is known. The heat roller-type fixing device generally includes a pair of rollers (e.g. a fixing roller and a pressing roller) each having an internal heat source, such as a halogen heater, etc. The pair of rollers rotates while heated and pressed against each other, forming a contact nip (e.g. a fixing-nip) therebetween. In such a system, a transfer medium bearing an un-fixed toner image thereon is conveyed through the fixing-nip (i.e., a contact nip) of the heat roller-type fixing device, so that the un-fixed toner image can melt and be fixed onto the transfer medium in the fixing-nip.

In recent years, in accordance with a growing demand for saving energy and shortening a waiting time in heating a fixing system, such as a warm-up time, a first time to print, etc., a so-called on-demand fixing unit is widely adopted, in which an endless belt is composed of a thin belt or film and the like instead of a heat roller to reduce a heat capacity of the fixing system as a whole, thereby improving effectiveness of heat transfer to the recording medium while greatly shortening the waiting time.

In a known example of this kind of fixing system, a fixed member (e.g., an opposed member) contacts an inner circumferential surface of a fixing belt sliding thereon and is pressed against a pressing roller via the fixing belt forming a fixing nip between the fixing belt and the pressing roller. The recording medium is conveyed to the fixing nip to fix the toner image borne on the recording medium onto the recording medium.

For example, JP-2002-108119-A discloses a technology in which a reflector reflects heat emanating from a halogen heater toward an opposite side of a film guide that guides and supports an endless film belt in a fixing nip formed on the endless film belt by pressing a pressing roller against the endless film belt as the belt travels in a prescribed direction through the nip. Accordingly, propagation of heat from a heat source can be given directionality by the reflector.

In such a conventional fixing device, however, when the reflector is to be deployed at a prescribed location relative to the above-described heat source, the reflector is generally fixed to a reinforcing member using a fastening member, such as a screw, etc. In addition, to fix the reflector with the screw, the reinforcing member is generally drilled and tapped as well, thereby incurring a cost increase due to these additional manufacturing processes.

Further, since the fastening member needs to be disposed in the constricted confines found inside the loop formed by the fixing belt so as not to interfere with other components, constricted layout of the components may be restricted or assembly complicated by the need to use a machine tool to attach the fastening member.

SUMMARY

Accordingly, as one aspect of the present invention, a novel fixing device fixes a toner image on a recording medium transported to a fixing nip by applying pressure and heat to the recording medium. Such a novel fixing device includes an endless belt formed into a loop with both ends bonded together, with the belt accommodating a heat source inside thereof, a pressing roller rotating in contact with the endless belt forming the fixing nip between the endless belt and the pressing roller, and a fixed member provided inside a loop of the endless belt to press the endless belt against a pressing roller. A reinforcing member is bonded to the fixed member inside the loop of the endless belt to reinforce the fixed member. A reflector is provided to reflect light emitted from the heat source toward the inner circumferential surface of the endless belt. The reflector is held on the reinforcing member by either plastically or elastically deforming by itself.

As another aspect of the present invention, a novel image forming apparatus includes a toner image forming unit to form a toner image and a fixing device. The fixing device includes an endless belt formed into a loop with both ends bonded together, with the belt accommodating a heat source inside thereof, a pressing roller rotating in contact with the endless belt forming the fixing nip between the endless belt and the pressing roller, and a fixed member provided inside a loop of the endless belt to press the endless belt against a pressing roller. A reinforcing member is bonded to the fixed member inside the loop of the endless belt to reinforce the fixed member. A reflector is provided to reflect light emitted from the heat source toward the inner circumferential surface of the endless belt. The reflector is held on the reinforcing member by either plastically or elastically deforming by itself.

As yet another aspect of the present invention, a fixing device that fixes a toner image on a recording medium transported to a fixing nip by applying pressure and heat to the recording medium and includes an endless belt formed into a loop with both ends bonded together, with the belt accommodating a heat source inside thereof; a pressing roller rotating in contact with the endless belt forming the fixing nip between the endless belt and the pressing roller; a fixed member provided inside a loop of the endless belt to press the endless belt against a pressing roller; a reinforcing member bonded to the fixed member inside the loop of the endless belt to reinforce the fixed member; and a reflector to reflect light emitted from the heat source toward the inner circumferential surface of the endless belt is assembled by a prescribed method.

The prescribed method includes the steps of: inserting the reinforcing member in a prescribed direction into the reflector until a fastening portion of the reflector either plastically or elastically deforms and generates a prescribed amount of bending; continuously inserting the reinforcing member in the prescribed direction until the fastening portion of the reflector completely overrides the reinforcing member and regains its original shape by its own plasticity or elasticity; hooking the fastening portion on the reinforcing member; and holding the reflector on the reinforcing member. The reflector is prepared by processing a plate-like member including a fastening portion therein contacting the reinforcing member to be held by the reinforcing member. The fastening portion is formed by applying either a bending process or a drawing process to the reflector.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
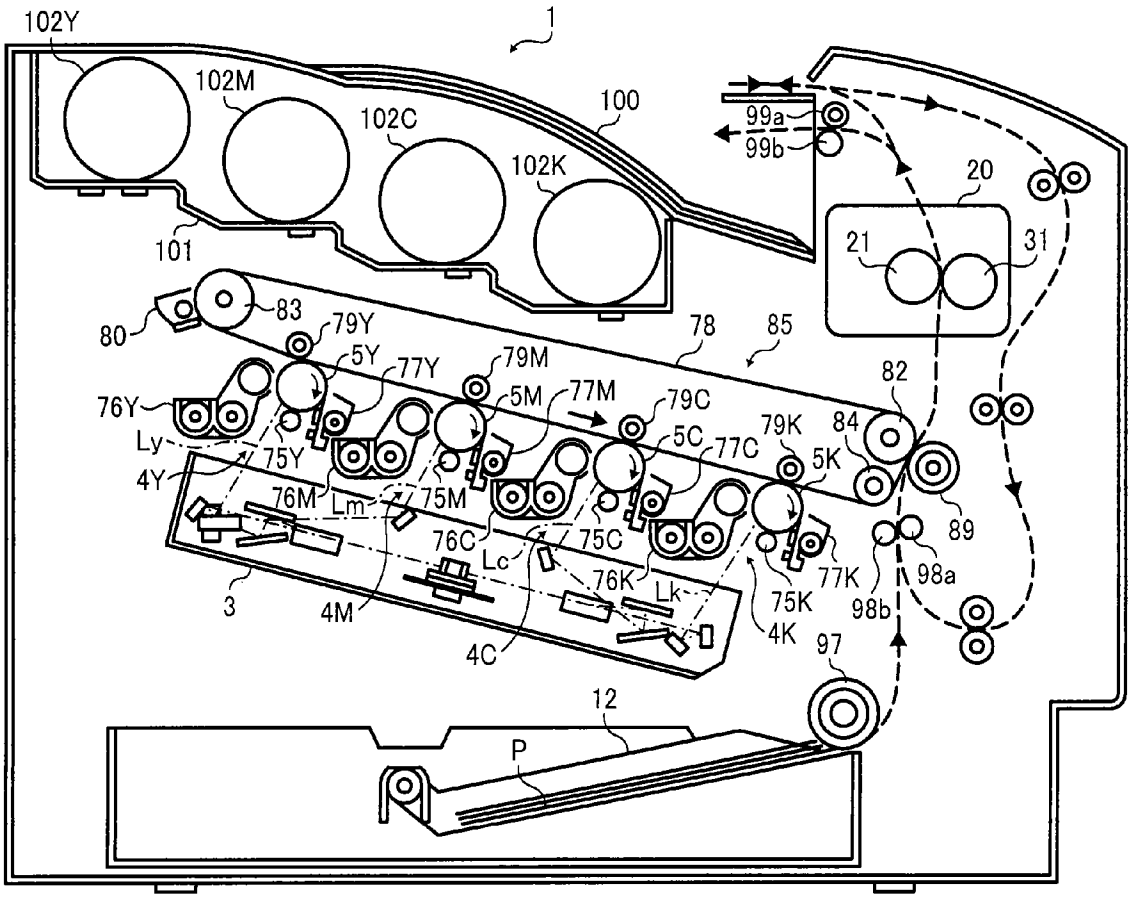
FIG. 1 is a perspective view illustrating an outline of an exemplary tandem-type color printer with a fixing device according to one embodiment of the present invention.

Referring now to the drawings, wherein like reference numerals designate identical or corresponding parts throughout the several views thereof and in particular to FIGS. 1 to 5, a fixing device and an image forming apparatus of a tandem color printer with the same are collectively illustrated according to one embodiment of the present invention.

Initially, an exemplary configuration of the image forming apparatus is described with reference to a diagram of FIG. 1. As shown there, the image forming apparatus 1 includes multiple image forming units 4Y, 4M, 4C, and 4K, a sheet feeding unit 12, a fixing device 20, an intermediate transfer unit 85, and a bottle accommodating unit 101 corresponding to each color (yellow (Y), magenta (M), cyan (C), and black (K)).

The bottle accommodating unit 101 is disposed at an upper portion in the image forming apparatus 1 and accommodates four-toner bottles 102Y, 102M, 102C, and 102K removable therefrom corresponding to each color.

The intermediate transfer unit 85 is provided below the bottle accommodating unit 101 and includes an intermediate transfer belt 78, four primary transfer bias rollers 79Y, 79M, 79C, and 79K, an intermediate transfer cleaning unit 80, and a secondary transfer backup roller 82. Further, the intermediate transfer unit 85 also has a cleaning backup roller 83 and a tension roller 84 as well.

The respective image forming units 4Y, 4M, 4C, and 4K include photoconductive drums 5Y, 5M, 5C, and 5K, charging units 75Y, 75M, 75C, and 75K, developing units 76Y, 76M, 76C, and 76K, cleaning units 77Y, 77M, 77C, and 77K, and charge removing units (not shown).

The photoconductive drums 5Y, 5M, 5C, and 5K are driven and rotated clockwise by a motor or respective motors (not shown) in FIG. 1. On each of the photoconductive drums 5Y, 5M, 5C, and 5K, a series of image forming processes of a charging process, an exposing process, a developing process, a transfer process, and a cleaning process are executed.

First, in the charging process, the photoconductive drums 5Y, 5M, 5C, and 5K are uniformly charged by the charge units 75Y, 75M, 75C, and 75K at positions of these charging units, respectively.

In the exposing processes, electrostatic latent images are formed by scanning exposure on the photoconductive drums 5Y, 5M, 5C, and 5K at respective positions, onto which multiple laser beams Ly, Lm, Lc, and Lk emanating from the exposing unit 3 arrives, on the photoconductor drum 5Y, 5M, 5C, and 5K.

Secondly, during the respective developing processes, the electrostatic latent images are developed by the developing devices 76Y, 76M, 76C, and 76K at respective opposing positions on the photoconductor drums 5Y, 5M, 5C, and 5K to the developing devices 76Y, 76M, 76C, and 76K. These allow the photoconductive drums 5Y, 5M, 5C, and 5K to bear respective color toner images when formed thereon.

Subsequently, during the respective primary transfer processes, toner images borne on the respective photoconductive drums 5Y, 5M, 5C, and 5K, are transferred onto the intermediate transfer belt 78 at opposing positions on the photoconductor drums 5Y, 5M, 5C, and 5K to the primary transfer bias roller 79Y, 79M, 79C, and 79K. In this stage, un-transferred toner slightly generally remains on the photoconductive drums 5Y, 5M, 5C, and 5K.

Secondly, during the respective cleaning process, the un-transferred toner remaining on the respective photoconductive drums 5Y, 5M, 5C, and 5K are mechanically collected by cleaning blades respectively provided in the cleaning units 77Y, 77M, 77C, and 77K at opposing positions on the photoconductive drums 5Y, 5M, 5C, and 5K to the cleaning units 77Y, 77M, 77C, and 77K.

Subsequently, residual potentials remaining on the respective photoconductor drum 5Y, 5M, 5C, and 5K are eliminated by the charge removing units at opposing positions on the photoconductor drum 5Y, 5M, 5C, and 5K to the charge removing units.

By completing the above-described series of image forming process, a color image is ultimately formed on the intermediate transfer belt 78.

The secondary transfer backup roller 82, the cleaning backup roller 83, and the tension roller 84 support the intermediate transfer belt 78 with a prescribed amount of tension applied from at least one of the secondary transfer backup roller 82, the cleaning backup roller 83, and the tension roller 84.

The four primary transfer bias rollers 79Y, 79M, 79C, and 79K and the photoconductive drums 5Y, 5M 5C, and 5K sandwich the intermediate transfer belt 78 and form respective primary transfer nips therebetween. Further, to each of the primary transfer bias rollers 79Y, 79M, 79C, and 79K, a prescribed transfer bias having an opposite polarity to that applied to the toner is applied.

The intermediate transfer belt 78 runs in a direction as shown in by arrow in FIG. 1 through the primary transfer nips formed on the respective primary transfer bias rollers 79Y, 79M, 79C, and 79K one by one as the secondary transfer backup roller 82 is driven and rotated.

The respective color toner images borne on the photoconductive drums 5Y, 5M, 5C, and 5K are primary transferred and superimposed on the intermediate transfer belt 78. Subsequently, the intermediate transfer belt 78 bearing the thus transferred and superimposed color toner images arrives at a position opposed to the secondary transfer roller 89.

The four-color toner image formed on the intermediate transfer belt 78 is transferred onto a recording medium P transported to the position of the secondary transfer nip formed between the secondary transfer backup roller 82 and the secondary transfer roller 89 collectively sandwiching the intermediate transfer belt 78 therebetween.

Subsequently, the intermediate transfer belt 78 reaches a position opposed to the intermediate transfer cleaning unit 80. Subsequently, an un-transferred toner not transferred onto the recording medium P and remaining on the intermediate transfer belt 78 is collected there.

The sheet feeding unit 12 is provided at a lower section in the image forming apparatus 1 accommodating a stack of multiple recording media P, such as transfer sheets, etc.

Now, an exemplary process to convey the recording medium P from the sheet feeding unit 12 is described with reference to FIG. 1 and applicable drawings. First, when a sheet feed roller 97 is driven and rotated counterclockwise in FIG. 1, the top most recording medium P accommodated in the sheet feeding unit 12 is conveyed toward a pair of registration rollers 98*a* and 98*b*.

Subsequently, the recording medium P temporarily stops at a roller nip formed between the pair of registration rollers 98*a* and 98*b*.

Subsequently, the recording medium P is conveyed towards the secondary transfer nip when the pair of registration rollers 98*a* and 98*b* is driven and is rotated synchronizing with the color image borne on the intermediate transfer belt 78 coming thereto. Hence, the color image is transferred ultimately onto the recording medium P.

The recording medium P with the thus transferred color image thereon at the secondary transfer nip is then conveyed to a position of the fixing device 20. Subsequently, the color image transferred onto the recording medium P is fused by heat and pressure applied by the fixing belt 21 serving as a belt and the pressing roller 31 serving as a pressing roller, respectively, onto the storage media P.

The recording medium P with the thus fixed color image thereon is then ejected outside the image forming apparatus 1 via a pair of exit rollers 99*a* and 99*b* and is stacked on a stacking unit 100 as an output image. Hence, a series of the image formation processes to be executed in the image forming apparatus 1 is completed.

Figure 2:
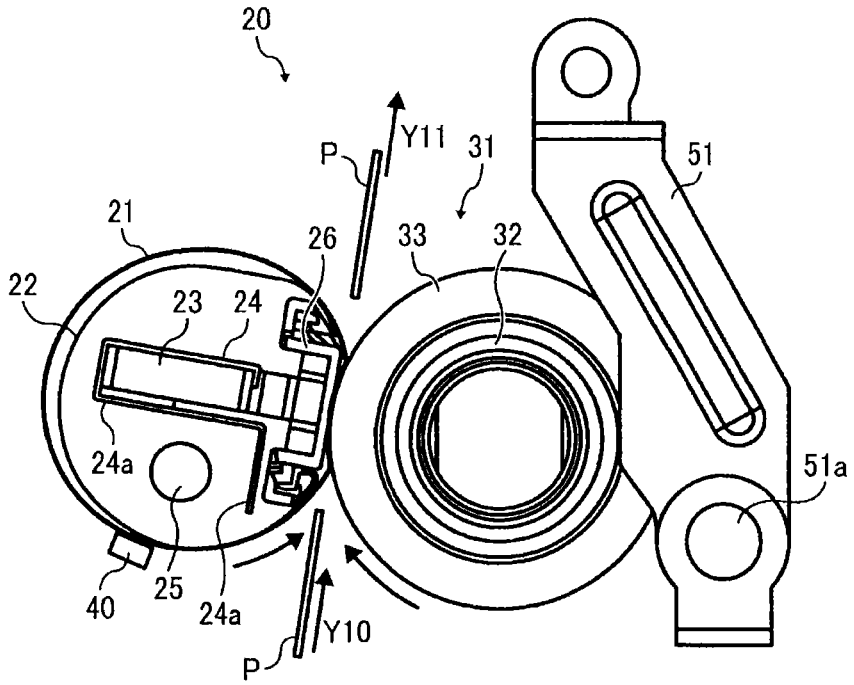
FIG. 2 is a cross-sectional view schematically illustrating an exemplary fixing device according to one embodiment of the present invention.

Now, an exemplary configuration of the fixing device 20 is described with reference to FIG. 2. As shown in FIG. 2, the fixing device 20 includes a heat transfer member 22, a reinforcing member 23, and a reflector 24. Also included are a heater 25 as a heat source, a fixing belt 21, and a fixed member 26. Further included are a pressing roller 31, a temperature sensor 40, and a pressure lever 51.

The fixing belt 21 is a thin-walled flexible endless-belt and is circulated in a direction as shown by arrow in FIG. 2. Herein, an endless state means a condition of the belt in that the belt is bonded seamlessly at both ends omitting a joint there, to form a single continuous band.

The fixing belt 21 is composed of a laminate including a substrate layer, an elastic layer, and a mold releasing layer sequentially stacked from its inner circumferential surface having a total thickness of less than 1 mm. The base layer of the fixing belt 21 has a layer thickness of from about 30 μm to about 100 μm, and is made of metal, such as nickel, stainless steel, etc., or resin, such as polyimide, etc., as one example.

The elastic layer of the fixing belt 21 has a layer thickness of from about 100 μm to about 300 μm and is made of rubber, such as silicone rubber, foam silicone rubber, fluorine rubber, etc. as one example.

Accordingly, with the elastic layer, slight bumpy is no longer formed on a surface of the fixing belt 21 so that heat is evenly conveyed to the color image borne on the recording medium P when the color image is fixed onto the recording medium P in a fixing nip formed between the fixing belt 21 and the pressing roller 31.

Here, the orange peel skin like image is an image having a number of fine convex and concave portions on a surface thereof.

The mold releasing layer of the fixing belt 21 has a layer thickness of from about 10 μm to about 50 μm and is made of prescribed material, such as PFA (tetrafluoroethylene-perfluoroalkylvinyl ether copolymer), PTFE (polytetrafluoroethylene), polyimide, polyether imide, PES (polyether sulfide), etc., as one example.

With the releasing layer, the fixing belt 21 can provide good releasability; i.e., is capable of smoothly separating from the color image on the recording medium P. A diameter of the fixing belt 21 is set to a prescribed value ranging from about 15 mm to about 120 mm. In particular, the diameter of the fixing belt 21 is set to approximately 30 mm in this embodiment just as one example. Further, mold releasing as a technical term means removal of objects glued to each other. Thus, releasability means the ease with which glued objects are able to separate from their counterparts.

Further, the pressing roller 31 contacting an outer circumferential surface of the fixing belt 21 at the position of the nip has a diameter of from about 30 mm to about 40 mm and is formed from a hollow metal core 32 and an elastic layer 33 overlying thereof, for example. The pressing roller 31 is pressed against the fixing belt 21 and forms a desired nip between the members of both parties.

The fixed member 26 is composed of heat-resistant resin, such as liquid crystal polymer, etc. Here, by providing an elastic member, such as silicone rubber, fluorine rubber, etc., between the fixed member 26 and the fixing belt 21, the surface of the fixing belt 21 can follow fine irregularities present on the surface of the recording medium P in the nip thereof. With this, since the fixing belt 21 uniformly provides heat to the color image borne on the recording medium P, occurrence of the image looking like the orange peel skin can be likely prevented.

Further, the fixed member 26 has a concave cross-section concave in a prescribed direction to follow a curvature of the pressing roller 31. As a result, a problem in that the recording medium P adheres to and does not separate from the fixing belt 21 after the fixing process is completed even though the recording medium P is launched following the curvature of the pressing roller 31 from the nip can be likely suppressed.

Further, the heat transfer member 22 is composed of a pile state member having a wall thickness of less than about 0.2 mm, for example, and is fixed and supported by a pair of side plates, not shown, provided in the fixing device 20 via its widthwise ends. Here, as a material of the heat transfer member 22, prescribed metals, such as aluminum, steel, stainless steel, etc., having prescribed heat conductivity may be used.

By setting the wall thickness of the heat transfer member 22 to be less than about 0.2 mm, the fixing device 20 can upgrade heating effectiveness of the fixing belt 21. The heat transfer member 22 is disposed near or contacting the surface of the fixing belt 21 except for the nip section. The heat transfer member 22 has an inwardly concave shape with a recess having an opening in the nip section.

Here, a gap between the fixing belt 21 and the heat transfer member 22 is preferably greater than about 0 mm and less than about 1 mm at a position other than the nip section when measured under room temperature, for example. Hence, the fixing device 20 can extend a sliding contact area in which the heat transfer member 22 and the fixing belt 21 contact each other while slipping therein, thereby capable of deterring a trouble of accelerating wear of the fixing belt 21.

Further, the fixing device 20 can likely prevent a problem in that the heat transfer member 22 and the fixing belt 21 are unfortunately separated too far from each other, and accordingly heating effectiveness of the fixing belt 21 deteriorates. Since a circular state of the flexible fixing belt 21 can be maintained somewhat in the fixing device 20 because the heat transfer member 22 is disposed near the fixing belt 21, deterioration of the fixing belt 21 caused by the deformation thereof can be reduced.

Further, to reduce friction resistance generated by the fixing belt 21 when it slides on the heat transfer member 22 in the fixing device 20, a prescribed area of the surface of the heat transfer member 22, on which the fixing belt 21 slides, may be made of prescribed material having a low coefficient of friction. Otherwise, a surface layer made of prescribed material containing fluorine can be formed on a prescribed inner circumferential surface of the fixing belt 21 as well.

Here, the heat transfer member 22 is heated by radiant heat or radiant light (herein below, simply referred to as radiant heat) emanating from the heater 25 configured by a carbon heater, a halogen heater, or the like and then heats the fixing belt 21. Specifically, the heater 25 directly heats the fixing device 20. By contrast, the heater 25 indirectly heats the fixing belt 21, because it is heated via the heat transfer member 22.

Further, in the present embodiment, an inner surface of the heat transfer member 22 is painted black to absorb heat. With this, the heat transfer member 22 of the fixing device 20 can enhance both effectiveness of absorbing infrared rays reflected by the reflector 24 and heat transfer effectiveness of transferring the heat to the fixing belt 21 as well.

Here, an output from the heater 25 is controlled based on a result of detection of surface temperature obtained by the temperature sensor 40 disposed facing the surface of the fixing belt 21. Accordingly, by controlling the output from the heater 25, fusing temperature of the fixing belt 21 can be set to a desired level capable of fixing the color image onto the recording medium P.

Hence, the fixing belt 21 of the fixing device 20 is not locally heated, but is entirely heated almost over the entire length thereof in the circumferential direction by the heat transfer member 22. With this, the fixing device 20 can likely prevent occurrence of fixing error even if the image forming apparatus is speeded up, because the fixing belt 21 can be fully sufficiently heated.

The reinforcing member 23 is provided inside a loop of the fixing belt 21 to reinforce and support the fixed member 26 that forms the nip. More specifically, the reinforcing member 23 is fixed and supported by a pair of side plates, not illustrated, provided in the fixing device 20 via its widthwise ends.

Since the reinforcing member 23 is pressed against the pressing roller 31 through the fixed member 26 and the fixing belt 21 as well, the fixed member 26 can likely avoid a problem of generating its large deformation due to receiving pressure from the pressing roller 31 in the nip.

Here, in order to satisfy the above-described function of the reinforcing member 23, the reinforcing member 23 is preferably made of metal, such as stainless steel, ferroalloy, etc., having high mechanical strength.

In addition, a profile of the reinforcing member 23 according to this embodiment is formed by stamping prescribed steel having a thickness of about 5 mm using a press working process and then applying a plating process thereto not to so easily oxidize even utilized under high temperature environment in order to reduce the respective costs of construction and material of parts, for example.

A cross section of the reflector 24 has a rectangular shape omitting one side (i.e., an opening is present in one side thereof), and extends upwardly to partially wrap up and almost pinch the reinforcing member 23 as shown in the drawing. With this, the reinforcing member 23 can hold the reflector 24 even with its simple shape produced only by applying the punching process to the flat plate.

Further, if the heater 25 as the heat source employs a heating system, such as halogen heater, etc., utilizing radiant heat, an insulation member can be either partially or entirely disposed in a reflective surface 24*a* of the reflector 24 facing the heater 25. Otherwise, BA (i.e., Bright Anneal) or specular polishing processes can be applied thereto as well.

As a result, since the radiant heat emanating from the heater 25 and directed toward the reinforcing member 23 (i.e., heat applied to the reinforcing member 23) is either insulated or reflected and is thereby used to heat the heat transfer member 22, effectiveness of heating the fixing belt 21 (and/or the heat transfer member 22) is further upgraded.

Further, a gear is attached to the pressing roller 31 to mesh with a driving gear provided in a driving mechanism, not shown, so that the pressing roller 31 can be driven and rotated in a direction as shown by arrow (i.e., clockwise) in FIG. 2. Further, the pressing roller 31 is supported by the pair of side walls, not shown, provided in the fixing device 20 via bearings through its widthwise ends, respectively, to freely rotate. Another heat source, such as a halogen heater, etc., not shown, may be installed again in the pressing roller 31 as well.

The elastic layer 33 of the pressing roller 31 is made of material, such as foam silicone rubber, silicone rubber, fluorocarbon rubber, etc. Further, a thin releasing layer made of material, such as PFA, PTFE, etc., can be provided on a surface of the elastic layered 33 as well.

Here, when the elastic layer 33 is made of sponge-like material such as foam silicone rubber, etc., since pressure acting on the nip section is weakened, an amount of bending of the fixed member 26 may be reduced. In such a situation, the effectiveness of heating the fixing belt 21 can be upgraded because heat of the fixing belt 21 rarely travels to the pressing roller 31 as well.

Further, as shown in the applicable drawing, there is provided a pressing lever 51 in the fixing device 20. The pressing lever 51 is supported by the pair of side plates of the fixing device 20, not shown, to freely rotate around a supporting shaft 51*a* mounted to its one end.

More specifically, a center of the pressing lever 51 engages with a bearing attached to the pressing roller 31. An elastic member, such as a compression spring, etc., not shown, is connected to the other end of the pressing lever 51.

With the configuration like this, when a fixing process is normally executed and the pressing lever 51 swings around the supporting shaft 51*a*, the pressing roller 31 is displaced in a prescribed direction and pressed against the fixing belt 21, thereby forming a desired nip therebetween.

By contrast, during a process (e.g., a sheet jam dealing process, etc.), other than the normal fixing process, an eccentric cam lever or the like, not shown, causes the pressing roller 31 to secede from the fixing belt 21 (or reduce a tension of the fixing belt 21).

Now, an operation executed in the fixing device 20 with the above-described configured during the normal fixing process is briefly described herein below with reference to applicable drawings. When a power switch provided in a main body of the image forming apparatus 1 is turned on, power is supplied to the heater 25 and rotation driving of the pressing roller 31 is initiated in a direction as shown by arrow in FIG. 2.

Hence, the fixing belt 21 also starts driven rotation due to friction applied by the pressing roller 31 in a direction as shown by arrow in FIG. 2. Subsequently, a recording medium P is fed from the sheet-feeding unit 12. An unfixed color image is subsequently transferred and borne on the recording medium P at the position of the secondary transfer roller 89 at a prescribe time as shown in FIG. 1.

The recording medium P with the unfixed color image (i.e., the color toner image) is conveyed in a direction as shown by arrow Y10 in FIG. 2 while a guide plate, not shown, guides it. The recording medium P is then inserted into the fixing nip formed between the pressing roller 31 and the fixing belt 21 in a pressure contacting condition.

Subsequently, the color toner image borne on the surface of the recording medium P is fused by heat provided by the fixing belt 21 heated by the heat transfer member 22 (heated originally by the heater 25) and pressure collectively applied from the pressing roller 31 and the fixed member 26 which is reinforced by the reinforcing member 23. Subsequently, the recording medium P is thrown from the fixing nip and is further conveyed downstream therefrom in a direction as shown by arrow Y11.

Figure 3A:
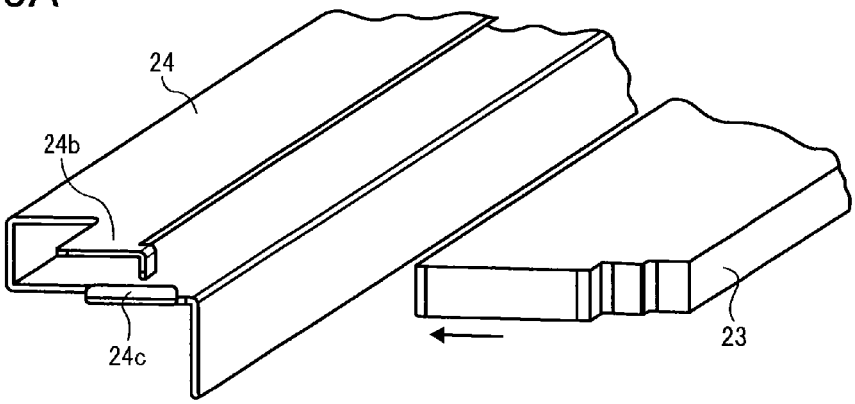
FIGS. 3A, 3B, and 3C are perspective views collectively schematically illustrating a process of assembling a reinforcing member and a reflector with each other according to one embodiment of the present invention.

Now, an exemplary process of assembling the reinforcing member 23 and the reflector 24 with each other according to one embodiment of the present invention is described with reference to FIGS. 3A to 3C, which are views collectively schematically illustrating the exemplary process. Specifically, FIG. 3A illustrates a condition of the reinforcing member 23 and the reflector 24 before the reinforcing member 23 and the reflector 24 are assembled with each other, and accordingly these devices do not contact each other.

Figure 3B:
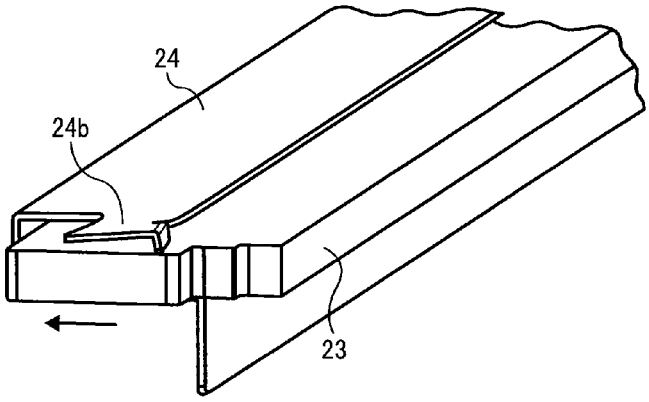

FIG. 3B illustrates a midst assembling stage of assembling the reinforcing member 23 and the reflector 24 with each other. Specifically, as shown there, as the reinforcing member 23 is inserted, a fastening portion 24*b* of the reflector 24 elastically deforms, so that the reflector 24 generates a prescribed amount of its own bending at its longitudinal (widthwise) end (ends). However, the reinforcing member 23 keeps advancing in a direction as shown by arrow in the drawing.

Figure 3C:
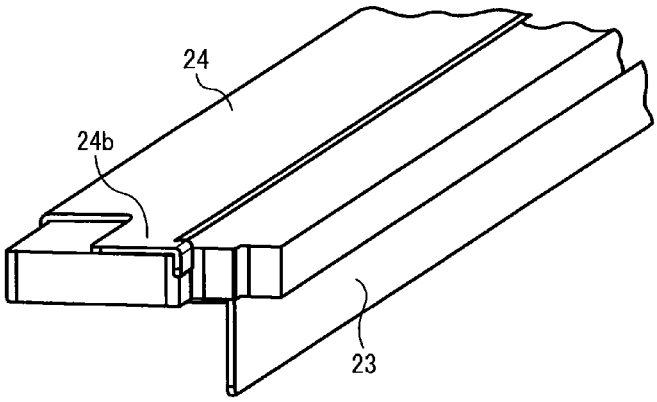

FIG. 3C illustrates a condition of the above-described assembling process when the reinforcing member 23 and the reflector 24 have been assembled with each other. As shown there, the reinforcing member 23 has further advanced from the state as shown in FIG. 3B in the direction as shown by arrow in the same drawing. With this, the fastening portion 24*b* of the reflector 24 (deforms and) completely overrides the reinforcing member 23 and finally regains its original shape by its own elasticity, so that the fastening portion 24*b* hooks on the reinforcing member 23, thereby completing the assembling process in this way. Accordingly, the reinforcing member 23 cannot disengage with the reflector 24 unless external force is intentionally applied to the fastening portion 24*b* to deform thereof in this state.

Hence, since the reinforcing member 23 and the reflector 24 can be assembled using elastic deformation of the parts themselves as executed in the above-described assembling step, a fastening parts such as a screw, etc., is not needed, and does not raise a cost for parts, which is generally raised due to increase in number of manufacturing processes, such as a prepared hole drilling process, a tapping process, etc.

Further, since an installation space for parts, such as a screw head, a screw tip, etc., is no longer needed to allocate in the fixing device 20, a freedom of layout increases even in a narrow internal space of the fixing belt 21. At the same time, since the assembling step can be executed by hand without requiring any additional tools, the ease of assembly can be upgraded.

Now, a positional relation between a contact section 24*c* in which the reinforcing member 23 and the reflector 24 contact each other and a heated area 24*d* of the reflector 24 directly heated by the heater 25 is described with reference to FIG. 4 that schematically illustrates the positional relation according to one embodiment of the present invention.

Figure 4:
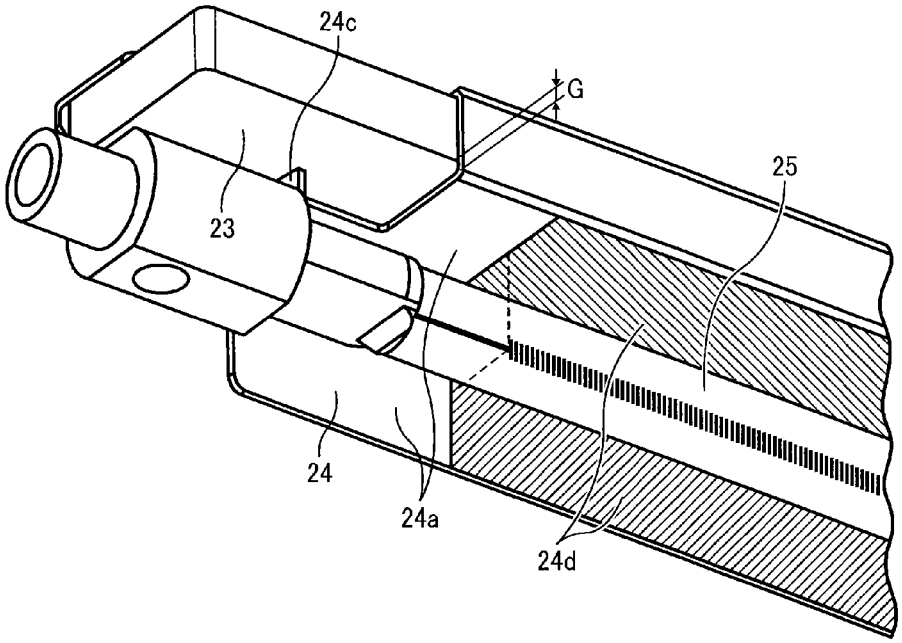
FIG. 4 is a perspective view schematically illustrating a positional relation between a contact section, in which the reinforcing member and the reflector contact each other and a heated area of the reflector directly heated by a heat source according to one embodiment of the present invention.

In FIG. 4, a reflective surface 24*a* of the reflector 24, opposed to the heater 25 ranging from one end to the other end of a coil section of the heater in its longitudinal (widthwise) direction defines a directly heated area 24*d*.

Hence, the reflector 24 has a contact section contacting the reinforcing member 23 in a region outside the directly heated area 24*d*. The contact section 24*c* is provided to form a prescribed gap G between the reinforcing member 23 and the reflective surface 24*a*. The contact section 24*c* has a prescribed shape capable of reducing a contact area contacting the reinforcing member 23 to improve insulation effectiveness therebetween.

With such a configuration, an air layer is created in the fixing device 20 between the reinforcing member 23 and the backside of the reflective surface 24*a*. Consequently, the configuration is advantageous in view of energy saving because good thermal insulation can be obtained, and accordingly energy generated by the heater 25 is not easily lost to the reinforcing member 23, thereby quickly raising temperature thereof.

As the material of the reflective surface 24*a* of the reflector 24 in this embodiment, a sheet metal made of aluminum with application of mirror-like surface treatment is utilized. This is because, the aluminum sheet metal is easy to bend and draw and apply the mirror finishing process, as well. In other words, the parts can be manufactured relatively inexpensively.

Further, a heat reflection effectiveness of the reflection surface 24*a* of the reflector 24 according to this embodiment varies depending on a position a longitudinal (widthwise) direction of the fixing belt 21 as described heretofore. That is, a prescribed range of the reflection surface 24*a* of the reflector 24 facing a widthwise range of the fixing belt 21, in which a recording medium P having a prescribed size most commonly used passes, has the highest heat reflection effectiveness.

Hence, the fixing device 20 is designed to be able to effectively heat the prescribed range of the fixing belt 21, in which the recording medium P having a most commonly used size passes to obtain fine thermal effectiveness while excellently saving energy.

Figure 5:
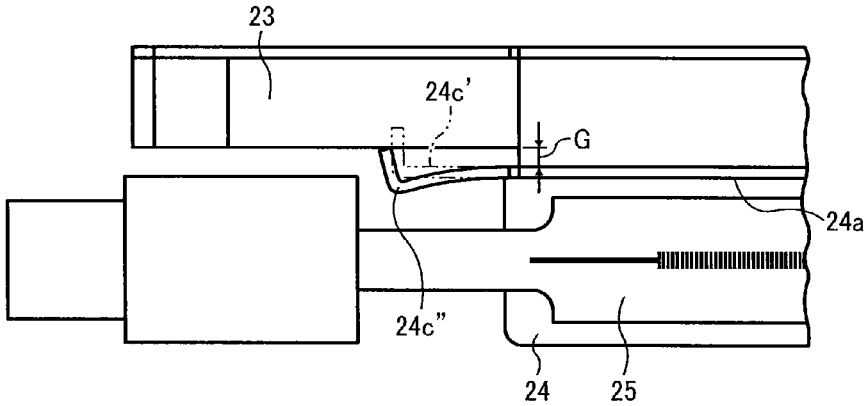
FIG. 5 is a side view schematically illustrating the contact section, in which the reinforcing member and the reflector contact each other, according to one embodiment of the present invention.

Now, the contact section in which the reinforcing member 23 and the reflector 24 contact each other according to one embodiment of the present invention is more specifically described with reference to FIG. 5 which schematically illustrates the contact section.

The contact section 24*c* of the reflector 24 has a prescribed size to take a posture as shown by a broken line 24*c*' and invades into the reinforcing member 23 as shown in the drawing, so that the contact section 24*c* of the reflector 24 is parallel with a reflective surface 24*a* and is located opposite the contact surface thereof contacting the reinforcing member 23 via the reinforcing member 23 under the no-load applied condition (i.e., before it is assembled with the reinforcing member 23).

Hence, when the reinforcing member 23 is assembled with the reflector 24, the contact section 24*c* deforms as shown by a rigid line 24*c*", so that weak elastic force works between the reinforcing member 23 and the contact section 24*c*. With this, the reinforcing member 23 and the reflector 24 are tied up to each other via the contact section 24*c*, in which the contact surface 24*c* and the reinforcing member 23 contact each other, so that the reflector surface 24*a* can be fixed regarding the heater 25 without backlash of it.

As described heretofore, with the fixing belt 21 with both ends being bonded having the heater 25 inside the fixing belt 21, the pressing roller 31 rotating in contact with the fixing belt 21, the fixed member 26 provided inside the fixing belt 21 to presses the fixing belt 21 against the pressing roller 31, the reinforcing member 23 connected to the fixed member 26 inside the fixing belt 21 to reinforce the fixed member 26, and the reflector 24 that reflects light emitted from the heater 25 toward the inner circumferential surface of the fixing belt 21, the fixing device 20 according to this embodiment can preferably fix the unfixed toner image onto the recording medium P transported to the fixing nip formed between the fixing belt 21 and the pressing roller 31 by applying heat and pressure to the recording medium P.

Further, the reflector 24 is configured to be held by the reinforcing member 23 due to its own elastic deformation or plastic deformation.

For this reason, the reinforcing member 23 and the reflector 24 can be secured to each other in the fixing device 20 without using the securing member such as the screw, etc., so that an increase in parts cost due to an increase in the number of manufacturing processes, such as the prepared hole drilling, the tapping, etc., for the screw can be avoided.

Further, because the fixing device 20 does not require the fastening member such as the screw, etc., a space for installing the fastening member is not needed, and flexibility in laying out the fastening member even in the constricted confines generally found inside the fixing belt 21 can be enhanced.

Further, since the fixing device 20 does not require the tool of the fastening member in the assembling process, the reinforcing member and the reflector 24 can be easily assembled with each other.

Further, the reflector 24 of the fixing device 20 according to this embodiment is prepared by processing the plate member having the contact section 24*c* contacting and held by the reinforcing member 23. The contact section 24*c* is formed by applying either the bending process or the drawing process to the reflector 24.

Accordingly, the reflector 24 of the fixing device 20 can be manufacture and prepared at low-cost. In addition, since the contact area, in which the contact section 24*c* and the reinforcing member 23 contact each other, is rendered to be very small, the insulating effectiveness can be enhanced.

Further, the reflector 24 of the fixing device 20 according to one embodiment of the present invention has the direct heating area 24*d* directly heated by the heater 25, while the contact section 24*c* is disposed outside the heated area 24*d*, while the reflector 24 is disposed not to contact the reinforcing member 23 in the directly heated area 24*d*.

For this reason, since the air layer is created between the reinforcing member 23 and the backside of the reflective surface 24*a* in the fixing device 20, good thermal insulation can be obtained. At the same time, the reinforcing member 23 rarely deprives heat generated and emitted from the heater 25, so that the fixing device 20 can easily quickly raise temperature while effectively saving energy.

Further, the fixing device 20 according to one embodiment of the present invention includes the pipe-shaped heat transfer member 22 having the internal heater 25 that faces the inner circumferential surface of the fixing belt 21. The inner circumferential surface of the heat transfer member 22 is painted black to absorb heat and is configured to transfer radiant heat from the heater 25 to the fixing belt 21.

For this reason, effectiveness of heat absorption of the infrared rays reflected by the reflector 24 in the heat transfer member 22 can be enhanced in the fixing device 20, so that effectiveness of heat transfer to the fixing belt 21 can be enhanced as well.

For this reason, effectiveness of heat absorption of the infrared ray reflected by the reflector 24 in the heat transfer member 22 can be enhanced in the fixing device 20, so that effectiveness of heat transfer to the fixing belt 21 can be also enhanced as well.

Further, the reflector 24 elastically deforms and accordingly provides elastic force to the contact section 24*c* when the reinforcing member 23 and the reflector 24 are assembled with each other in the fixing device 20 according to one embodiment of the present invention.

Accordingly, the reinforcing member 23 and the reflector 24 can be fixed to each other by the elastic force of the contact section 24*c* in the fixing device 20 without backlash of those.

In addition, heat reflection effectiveness of the reflector 24 is different depending on a position in its widthwise direction θ of the fixing belt 21 in the direct heated area 24*d* in the fixing device 20 according to one embodiment of the present invention.

Because of this, the widthwise area θ of the fixing belt 21, in which a recording medium P most frequently passes through and accordingly particularly requiring the heat, can be effectively heated. Thus, the fixing device 20 can obtain preferable thermal effectiveness with superior performance of energy saving in the fixing device 20 according to one embodiment of the present invention.

Further, the reinforcing member 23 is prepared using the sheet of the plate member in the fixing device 20 according to one embodiment of the present invention.

Thus, both material and processing costs of the reinforcing member 23 of the fixing device 20 can be reduced according to one embodiment of the present invention.

Further, at least a portion of the contact section 24*c* is positioned to be parallel to the reflective surface 24*a* of the reflector 24, and is opposed to the surface of the reflector 24 in contact with the reinforcing member 23 via the reinforcing member 23 in the fixing device 20 according to one embodiment of the present invention.

Accordingly, the reinforcing member 23 can be pressed down by the elastic force generated by the elastic deformation of the contact portion 24*c* at the contact section, in which the reflector 24 and the reinforcing member 23 contact each other, the reinforcing member 23 and the reflector 24 can be fixed to each other without backlash of those in the fixing device 20 according to one embodiment of the present invention.

Here, although the shape of the fixed member 26 forming the nip is concave as shown in FIG. 2, the shape of the fixed member 26 is not limited to the above-described example, and can be flat or continuously vary from a plane to a concaved shape to form the nip section as a modification.

Specifically, when the shape of the nip becomes almost parallel to an image plane borne on the recording medium P, the fixed member 26 is effective in preventing wrinkles from occurring in the recording medium P. In addition, adhesion of the fixing belt 21 to the recording medium P increases and fixing performance of the color image onto the recording medium P is improved as a result, because the cross-sectional shape of the fixed member 26 approximates the concave shape. Further, the curvature of the fixing belt 21 increases in the exit side of the nip in the fixing device 20, the recording medium P sent out from the nip can be easily separated from the fixing belt 21.

Further, although the cross-section of the heat transfer member 22 almost has the circular shape in the fixing device 20 according to one embodiment of the present invention, the shape thereof is not limited to this and can be polygonal as a modification. Yet further, when a means that uniformly conveys heat from the heat source to the belt and ensures driving stability of the belt during its driving is separately provided, the fixing device 20 can omit the heat transfer member 22 and may be composed of a fixing device to directly heat the belt as a modification.

In such a situation, since heat capacity of the heat transfer member 22 can be eliminated from the total heat capacity of the fixing device 20, the fixing device 20 can be more readily raise its temperature while greatly saving energy as a sophisticated fixing instrument.

Yet further, although the space exists in the gap G formed between the reinforcing member 23 and the reflector 24 in the fixing device 20 according to one embodiment of the present invention, the gap G is not limited to the above-described example and may be filled with insulating member therein as a modification. With this, the modified fixing device 20 can improve insulation performance.

Further, although the pressing roller 31 is configured only to include the metal core 32 inside thereof in the fixing device 20 according to one embodiment of the present invention, the pressing roller 31 is not limited to the above-described example and can include a heat source, such as a halogen heater, etc., inside thereof as a modification.

Yet further, although the diameter of the fixing belt 21 is designed to be equivalent to the diameter of the pressing roller 31 in the fixing device 20 according to one embodiment of the present invention, the diameter of the fixing belt 21 may be smaller than the diameter of the pressing roller 31 as a modification.

In such a situation, since the curvature of the fixing belt 21 is smaller than that of the pressing roller 31 in the fixing nip, the recording medium P thrown from the fixing nip of the fixing belt 21 can be readily separated from the fixing belt 21.

Further, the diameter of the fixing belt 21 can be larger than the diameter of the pressing roller 31 by contrast. In any way, however, regardless of a relation between the diameter of the fixing belt 21 and the diameter of the pressing roller 31, the fixing device 20 is configured not to apply pressure of the pressing roller 31 to the transmission heat member 22 in the fixing device 20 according to one embodiment of the present invention.

Yet further, although the contact section 24*c* is produced and prepared by applying the bending process to the plate like member as shown in FIG. 4 in the fixing device 20 according to one embodiment of the present invention, it is not limited to this and the contact section 24*c* can be formed to have an aperture shape using an embossing process or the like as shown in FIG. 6 as a modification.

Yet further, although the elastic deformation of the reflector 24 is used to fix the reinforcing member 23 and the reflector 24 with each other in the fixing device 20 according to one embodiment of the present invention, but it is not limited to this and plastic deformation of the reflector 24 may be used to fix the reinforcing member 23 and the reflector 24 to each other in the fixing device 20 as shown in FIG. 6 according to another embodiment of the present invention.

Now, a situation in which the plastic deformation of the reflector 24 is used to fix the reinforcing member 23 and the reflector 24 with each other is described herein below with reference to in the fixing device 20 and applicable drawings. First, the reinforcing member 23 is obliquely inserted against the reflector 24 (toward the reflector 24) in a direction as shown by arrow Y21 in FIG. 6A until it hits a bend 24*e* formed in the reflector 24.

Figure 6A:
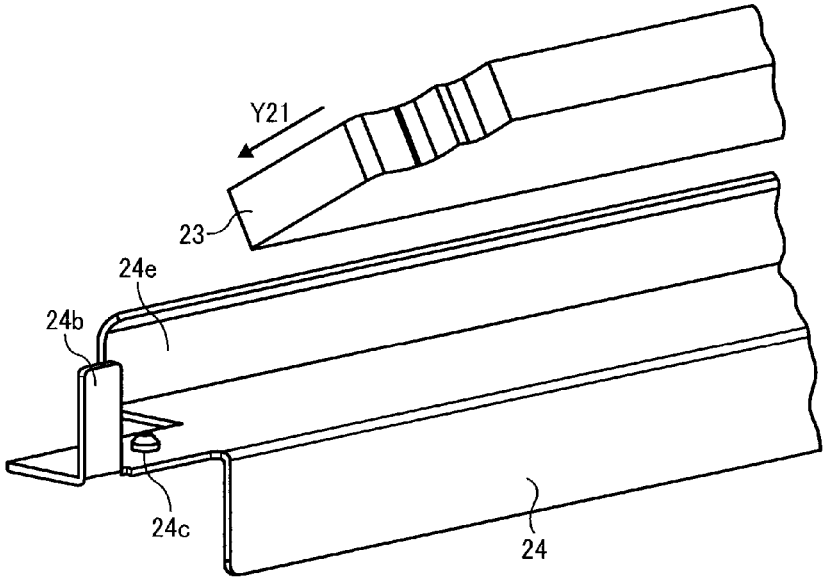
FIGS. 6A, 6B, 6C, and 6D are perspective views collectively schematically illustrating a process of assembling a reinforcing member and a reflector with each other according to another embodiment of the present invention.
Figure 6B:
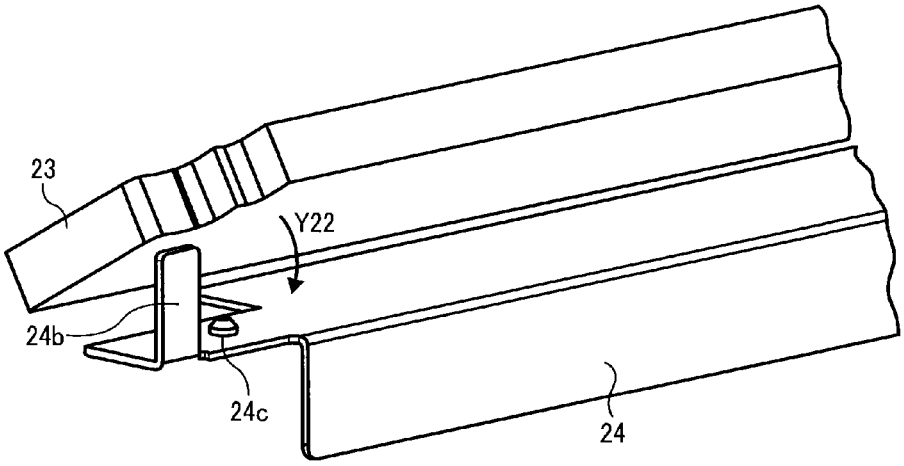
Figure 6C:
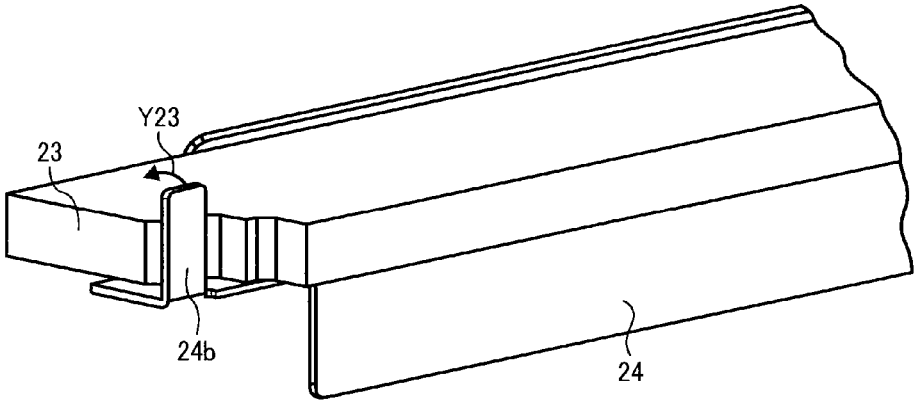

Subsequently, the reinforcing member 23 is rotated in a direction as shown by arrow Y22 in FIG. 6B and is positioned so that the bottom of the reinforcing member 23 and the back side 24*a* of the reflector 24 roughly become parallel to each other as shown in FIG. 6C.

Figure 6D:
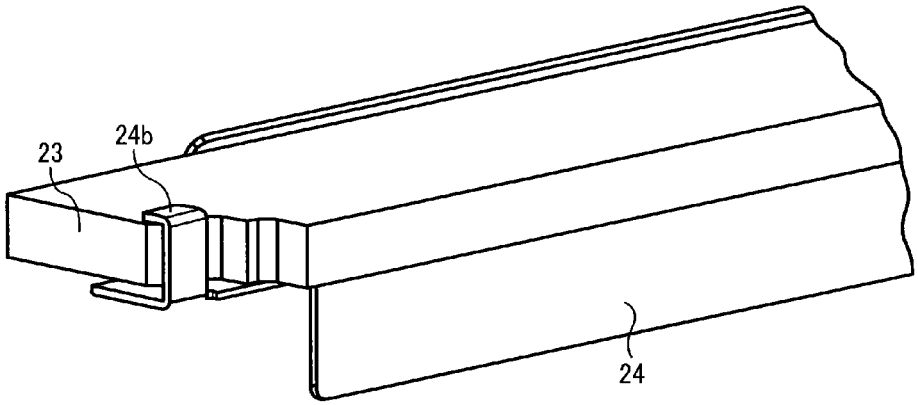

As shown in FIG. 6D, a pair of tips of the fastening portion 24*b* provided in both ends of the reflector 24 respectively in its longitudinal (widthwise) direction (note, only one end thereof is shown in this drawing) are bent in a direction as shown by arrow Y23 in accordance with a thickness of the reinforcing member 23, so that relative positional relation of those members are fixed.

Hence, as described heretofore, by using the plastic deformation of the reflector 24 in fixing the reinforcing member 23 and the reflector 24 to each other, the fixing device 20 can be assembled without using the fixing member as in the situation in which the elastic deformation is utilized as well. This allows the fixing device 20 to avoid increase in cost of parts while ensuring a preferable ease of assembly as well.

According to one aspect of the present invention, by holding the reflector on the reinforcing member utilizing plastic or elastic deformation of the reflector, a fixing device readily assembled without using a particular fastening member at low cost can be provided. Because, to fix a toner image on a recording medium transported to a fixing nip by applying pressure and heat to the recording medium, the fixing device includes an endless belt formed into a loop with both ends bonded together, with the belt accommodating a heat source inside thereof, a pressing roller rotating in contact with the endless belt forming the fixing nip between the endless belt and the pressing roller, and a fixed member provided inside a loop of the endless belt to press the endless belt against a pressing roller. A reinforcing member is bonded to the fixed member inside the loop of the endless belt to reinforce the fixed member. A reflector is provided to reflect light emitted from the heat source toward the inner circumferential surface of the endless belt. The reflector is held on the reinforcing member by either plastically or elastically deforming by itself. Further because, according to another aspect of the present invention, the reflector is prepared by processing a plate-like member forming a contact section therein contacting the reinforcing member to be held by the reinforcing member, wherein the contact section is formed by applying either a bending process or a drawing process to the reflector. Yet further because, according to another aspect of the present invention, the reflector has a directly heated area directly heated by the heat source. The reflector is provided in the directly heated area not to contact the reinforcing member. The directly heated area corresponds to a range the heat source. The contact section is located outside the directly heated areas. Further because, according to another aspect of the present invention, an insulation member is provided between the reflector and the reinforcing member in the directly heated area. Further because, according to another aspect of the present invention, a pipe-shaped heat transfer member is provided to face the inner circumferential surface of the endless belt accommodating the heat source inside thereof. The inside of the heat transfer member is painted black to absorb heat. The heat transfer member transfers radiant heat emanating from the heat source toward the endless belt. Yet further because, according to another aspect of the present invention, the reflector applies elastic force to the contact section by elastically deforming by itself when the reflector and the reinforcing member are assembled with each other. Further because, according to another aspect of the present invention, reflection effectiveness of the reflector in the directly heated area varies depending on a position thereon in a widthwise direction of the endless belt in accordance with a frequency of usage of a sheet size of the recording medium. Further because, according to another aspect of the present invention, the reinforcing member is prepared from a single sheet of a plate like member. Yet further because, according to another aspect of the present invention, at least a portion of the contact section is parallel to a reflective surface of the reflector that reflects light emitted from the heat source toward the inner circumferential surface of the endless belt, and opposed to a surface of the reflector in contact with the reinforcing member via the reinforcing member.

Numerous additional modifications and variations of the present invention are possible in light of the above teachings. It is therefore to be understood that within the scope of the appended claims, the present invention may be executed otherwise than as specifically described herein. For example, the order of steps for forming the image forming apparatus is not limited to the above-described various embodiments and can be appropriately changed.

What is claimed is:

1. A fixing device for fixing a toner image borne on a recording medium transported to a fixing nip by applying pressure and heat to the recording medium, the fixing device comprising:

an endless belt formed into a loop with both ends bonded together, the belt accommodating a heat source inside a loop thereof;

a pressing roller rotating in contact with the endless belt forming a fixing nip between the endless belt and itself;

a fixed member provided inside the loop of the endless belt to press the endless belt against the pressing roller;

a reinforcing member bonded to the fixed member inside the loop of the endless belt to reinforce the fixed member; and a reflector to reflect light emitted from the heat source toward the inner circumferential surface of the endless belt, wherein the reflector is plastically or elastically held on the reinforcing member by the reflector either plastically or elastically deforming, and a distance across the reflector in a conveyance direction of the recording medium through the fixing nip is greater than a distance across the reinforcing member in the conveyance direction.

2. The fixing device as claimed in claim 1, wherein the reflector is prepared by processing a plate of material while at least including a contact section to contact the reinforcing member when held by the reinforcing member, wherein the contact section is formed by further applying either a bending process or a drawing process to the reflector.

3. The fixing device as claimed in claim 2, wherein the reflector has a directly heated area directly heated by the heat source, the reflector being separated from the reinforcing member in the directly heated area, the contact section located outside the directly heated area, wherein the directly heated area corresponds to a widthwise range of the heat source.

4. The fixing device as claimed in claim 3, further comprising:

an insulation member provided between the reflector and the reinforcing member in the directly heated area.

5. The fixing device as claimed in claim 2, wherein the reflector applies elastic force to the contact section by elastically deforming when the reflector is assembled with the reinforcing member.

6. The fixing device as claimed in claim 2, wherein the contact section has a prescribed size to take a posture under a no-load applied condition such that a portion of the contact section is parallel to a reflective surface of the reflector, the portion of the contact section being opposed to a contact surface of the reflector via the reinforcing member when assembled, the contact surface contacting the reinforcing member when assembled, the contact section intruding into a space for accommodating the reinforcing member.

7. The fixing device as claimed in claim 1, further comprising:

a pipe-shaped heat transfer member disposed facing the inner circumferential surface of the endless belt, the heat transfer member accommodating the heat source inside thereof and transferring radiant heat emanating from the heat source toward the endless belt, wherein the inside of the heat transfer member is coated with a heat-absorbing material.

8. The fixing device as claimed in claim 1, wherein a heat reflection effectiveness of the reflector in a directly heated area varies depending on a position thereon in a widthwise direction of the endless belt, based on a frequency of a usage size of the recording medium.

9. The fixing device as claimed in claim 1, wherein the reinforcing member is prepared from a single plate of material.

10. An image forming apparatus, comprising:

a toner image forming unit to form a toner image; and a fixing device to fix a toner image borne on a recording medium transported to a fixing nip by applying pressure and heat to the recording medium, the fixing device comprising:

an endless belt formed into a loop with both ends bonded together, the belt accommodating a heat source inside a loop thereof;

a pressing roller rotating in contact with the endless belt forming a fixing nip between the endless belt and itself;

a fixed member provided inside the loop of the endless belt to press the endless belt against the pressing roller;

a reinforcing member bonded to the fixed member inside the loop of the endless belt to reinforce the fixed member; and a reflector to reflect light emitted from the heat source toward the inner circumferential surface of the endless belt, wherein the reflector is plastically or elastically held on the reinforcing member by the reflector either plastically or elastically deforming, and a distance across the reflector in a conveyance direction of the recording medium through the fixing nip is greater than a distance across the reinforcing member in the conveyance direction.

11. The image forming apparatus as claimed in claim 10, wherein the reflector is prepared by processing a plate of material while at least including a contact section to contact the reinforcing member when held by the reinforcing member, wherein the contact section is formed by further applying either a bending process or a drawing process to the reflector.

12. The image forming apparatus as claimed in claim 11, wherein the reflector has a directly heated area directly heated by the heat source, the reflector being separated from the reinforcing member in the directly heated area, the contact section located outside the directly heated area, wherein the directly heated area corresponds to a widthwise range of the heat source.

13. The image forming apparatus as claimed in claim 12, further comprising:

an insulation member provided between the reflector and the reinforcing member in the directly heated area.

14. The image forming apparatus as claimed in claim 11, wherein the reflector applies elastic force to the contact section by elastically deforming when the reflector is assembled with the reinforcing member.

15. The image forming apparatus as claimed in claim 11, wherein the contact section has a prescribed size to take a posture under a no-load applied condition such that a portion of the contact section is parallel to a reflective surface of the reflector, the portion of the contact section being opposed to a contact surface of the reflector via the reinforcing member when assembled, the contact surface contacting the reinforcing member when assembled, the contact section intruding into a space for accommodating the reinforcing member.

16. The image forming apparatus as claimed in claim 10, further comprising:

a pipe-shaped heat transfer member disposed facing the inner circumferential surface of the endless belt, the heat transfer member accommodating the heat source inside thereof and transferring radiant heat emanating from the heat source toward the endless belt, wherein the inside of the heat transfer member is coated with a heat-absorbing material.

17. The image forming apparatus as claimed in claim 10, wherein a heat reflection effectiveness of the reflector in a directly heated area varies depending on a position thereon in a widthwise direction of the endless belt, based on a frequency of a usage size of the recording medium.

18. The image forming apparatus as claimed in claim 10, wherein the reinforcing member is prepared from a single plate of material.

19. A method of assembling a fixing device that fixes a toner image on a recording medium transported to a fixing nip by applying pressure and heat to the recording medium, the fixing device including: an endless belt formed into a loop with both ends bonded together, the belt accommodating a heat source inside thereof; a pressing roller rotating in contact with the endless belt forming the fixing nip between the endless belt and the pressing roller; a fixed member provided inside a loop of the endless belt to press the endless belt against a pressing roller; a reinforcing member bonded to the fixed member inside the loop of the endless belt to reinforce the fixed member; and a reflector to reflect light emitted from the heat source toward the inner circumferential surface of the endless belt, the reflector prepared by processing a plate of material including a fastening portion therein contacting the reinforcing member when held by the reinforcing member, the fastening portion formed by applying either a bending process or a drawing process to the reflector, the method comprising:

inserting the reinforcing member in a prescribed direction into the reflector until a fastening portion of the reflector elastically deforms and generates a prescribed amount of bending;

continuously inserting the reinforcing member in the prescribed direction until the fastening portion of the reflector completely overrides the reinforcing member and regains its original shape by its own elasticity;

hooking the fastening portion on the reinforcing member; and holding the reflector on the reinforcing member.

20. The method of assembling a fixing device as claimed in claim 19, wherein the reinforcing member is prepared from a single plate of material.

* * * * *